US010400622B2

(12) United States Patent
Leopold

(10) Patent No.: US 10,400,622 B2
(45) Date of Patent: Sep. 3, 2019

(54) GUIDE VANE ADJUSTING DEVICE AND TURBOMACHINE

(71) Applicant: MAN DIESEL & TURBO SE, Augsburg (DE)

(72) Inventor: Lennart Leopold, Berlin (DE)

(73) Assignee: MAN Energy Solutions SE, Augsburg (DE)

( * ) Notice: Subject to any disclaimer, the term of this patent is extended or adjusted under 35 U.S.C. 154(b) by 47 days.

(21) Appl. No.: 15/566,508

(22) PCT Filed: Mar. 31, 2016

(86) PCT No.: PCT/EP2016/057083

§ 371 (c)(1),
(2) Date: Oct. 13, 2017

(87) PCT Pub. No.: WO2016/165950

PCT Pub. Date: Oct. 20, 2016

(65) Prior Publication Data

US 2018/0119566 A1 May 3, 2018

(30) Foreign Application Priority Data

Apr. 15, 2015 (DE) ..... 10 2015 004 649

(51) Int. Cl.
*F01D 17/16* (2006.01)
*F01D 9/04* (2006.01)

(52) U.S. Cl.
CPC ..... *F01D 17/162* (2013.01); *F01D 9/041* (2013.01); *F05D 2260/57* (2013.01)

(58) Field of Classification Search
CPC ..... F01D 17/162; F01D 17/165; F01D 9/041; F01D 17/10; F04D 27/002; F04D 29/056
See application file for complete search history.

(56) References Cited

U.S. PATENT DOCUMENTS 5,096,374 A * 3/1992 Sakai ..... F01D 17/162 384/206
5,281,087 A 1/1994 Hines
(Continued)

FOREIGN PATENT DOCUMENTS

DE 10351202 6/2005
DE 10 2005 038176 3/2006
(Continued)

OTHER PUBLICATIONS

Office Action dated Oct. 15, 2018 issued in Japanese Patent Application No. 2017-553975.

*Primary Examiner* — Long T Tran
(74) *Attorney, Agent, or Firm* — Cozen O'Connor

(57) ABSTRACT

A guide vane adjusting device for rotating guide vanes in a guide vane assembly having a driveshaft and a control ring that transmits a driveshaft rotation of the driveshaft to rotate the guide vanes. Each guide vane has a front and a rear vane part, which can be rotatable relative to each other about a respective guide vane rotational axis. The driveshaft is directly coupled to one of the guide vanes such that the vane parts are directly rotated without the interposition of the control ring. The driveshaft is indirectly coupled to the other guide vanes such that the guide vane parts are rotated indirectly with the interposition of the control ring. A respective drive lever acts on a bearing pin of the front vane part and a bearing pin of the rear vane part of the guide vane. The drive lever are coupled together via a respective coupling device.

11 Claims, 10 Drawing Sheets

(56) References Cited

U.S. PATENT DOCUMENTS

| | | | | |
|---|---|---|---|---|
| 5,362,202 | A * | 11/1994 | Derouet | F01D 11/22 415/148 |
| 2006/0062667 | A1* | 3/2006 | Bourgoin | F01D 17/162 415/199.1 |
| 2009/0074569 | A1* | 3/2009 | Garcin | F01D 17/16 415/148 |
| 2012/0243973 | A1* | 9/2012 | Kierat | F01D 17/165 415/148 |
| 2012/0308364 | A1* | 12/2012 | Hofmann | F01D 17/162 415/148 |
| 2014/0064875 | A1* | 3/2014 | Twell | F01D 17/10 411/116 |

FOREIGN PATENT DOCUMENTS

| | | |
|---|---|---|
| GB | 2 264 148 | 8/1993 |
| GB | 2 398 607 | 8/2004 |
| JP | 56-143533 U1 | 3/1955 |
| JP | 2003-172145 | 6/2003 |
| JP | 2005-009497 | 1/2005 |
| JP | 2006-063981 | 3/2006 |
| JP | 2014-211159 | 11/2014 |
| WO | WO 2013/087863 | 6/2013 |

* cited by examiner

GUIDE VANE ADJUSTING DEVICE AND TURBOMACHINE

CROSS REFERENCE TO RELATED APPLICATIONS

This is a U.S. national stage of application No. PCT/EP2016/057083, filed on Mar. 31, 2016. Priority is claimed on German Application No. DE102015004649.7, filed Apr. 15, 2015, the content of which is incorporated here by reference.

BACKGROUND OF THE INVENTION

1. Field of the Invention

The invention relates to a guide vane adjusting device for a turbo machine and to a turbo machine having such a guide vane adjusting device.

2. Description of the Prior Art

Turbo machines known from practice comprise a rotor and a stator. The rotor of a turbo machine comprises a shaft and a plurality of moving plates rotating together with the shaft, wherein the moving blades form at least one moving blade row. The stator of a turbo machine comprises a housing and a plurality of fixed guide vanes, wherein the guide vanes form at least one guide vane ring. The guide vanes known from practice are embodied in one piece. From practice it is already known to adjust the guide vanes of a guide vane ring of a turbo machine via a guide vane adjusting device such that the guide vanes are rotatable about a guide vane axis extending in the radial direction of the rotor. Guide vane adjusting devices known from practice comprise a driveshaft to which a drive motor can be coupled and which is driveable via the drive motor. In guide vane adjusting devices known from practice, the rotation of the driveshaft via the drive motor is transmitted to all guide vanes of a guide vane ring by a control ring, so that accordingly all guide vanes of a guide vane ring are adjusted or rotated indirectly starting out from the driveshaft with the interposition of the control ring. In order to reduce flow pressure losses on a guide vane ring and increase the efficiency it is desirable to employ multi-part guide vanes on guide vane rings. However, no guide vane adjusting devices have become known to date with which multi-part guide vanes of a guide vane ring can be easily rotated incurring only minor friction and minor torsional loading.

SUMMARY OF THE INVENTION

Starting out from this, one aspect of the invention is based on creating a new type of guide vane adjusting device for a turbo machine and a turbo machine having such a guide vane adjusting device.

According to one aspect of the invention, each guide vane comprises a front vane part and a rear vane part, which are each rotatable about a common axis of rotation, namely the respective guide vane axis of rotation, relative to one another. The driveshaft is directly coupled to one of the guide vanes of the guide vane ring such that the vane parts of this guide vane of the guide vane ring starting out from the driveshaft are directly rotatable without interposition of the control ring. The driveshaft is indirectly coupled to the other guide vanes of the guide vane ring in such a manner that the vane parts of the other guide vanes of the guide vane ring are indirectly rotatable starting out from the driveshaft with the interposition of the control ring. A respective drive lever acts on a bearing pin of the front vane part and a bearing pin of the rear vane part of each guide vane, wherein the drive levers of the vane parts of the guide vanes are coupled among one another via a coupling device each in such a manner that the vane parts of the guide vanes are synchronously rotatable. The guide vane adjusting device according to the invention makes possible the rotation of multi-part guide vanes about guide vane axes of rotation extending in radial direction, namely in such a manner that a front vane part and a rear vane part of each guide vane are synchronously rotatable in each case about a common axis of rotation. The synchronous rotation of the vane parts of each guide vane relative to one another can take place proportionally or non-proportionally. Vane parts of a guide vane are rotatable directly by the driveshaft without interposition of the control ring, whereas the vane parts of the other guide vanes are indirectly rotatable starting out from the drive shaft with the interposition of the control ring. Here, the control ring is displaceable preferentially in circumferential direction and in axial direction and exclusively fixed in radial direction. Vane parts of multi-part guide vanes of a guide vane ring can be synchronously rotated with the guide vane adjusting device incurring low friction and torsional loading.

According to an advantageous further development of the invention, the respective coupling device is coupled in the region of each guide vane to one of the drive levers about an axis running parallel to the respective guide vane axis of rotation by way of a pin, which is guided in a guide groove of the respective other drive lever and in a guide groove of a housing structure of the guide vane ring. By way of this, a particularly advantageous coupling of the rotation of the vane parts of each guide vane of the guide vane ring is possible. The movement of the vane parts of the guide vanes relative to one another is uniquely determined by the assemblies involved.

According to a further advantageous further development of the invention, a each one of the drive levers, which act on the bearing pins of the vane parts of the respective guide vane, is coupled to the control ring in the region of each guide vane. This makes possible a particularly advantageous displacement of the rotation of the vane parts of the guide vanes initiated by the driveshaft to all guide vanes of the guide vane ring.

Preferentially, the control ring is displaceable in circumferential direction and in axial direction so that forces at coupling points between the control ring and the drive levers, which are coupled to the control ring in an articulated manner rung perpendicularly to the drive levers. Forces at the coupling points between the control ring and the drive levers that are coupled to the control ring always run perpendicularly to the drive levers. Because of this it can be ensured that bearings of the guide vane or guide vane parts are not loaded by parasitic force components. Ultimately, the loading of the guide vane parts and bearings is reduced as a result of which the guide vane adjusting device is also exposed to lower loads and can therefore be dimensioned with lower installation space requirements.

BRIEF DESCRIPTION OF THE DRAWINGS

Preferred further developments of the invention are obtained from the subclaims and the following description.

Exemplary embodiments of the invention are explained in more detail by way of the drawing without being restricted to this. There it shows.

DETAILED DESCRIPTION OF THE PRESENTLY PREFERRED EMBODIMENTS

The present invention relates to a guide vane adjusting device for a turbo machine and to a turbo machine having at least one such guide vane adjusting device.

The person skilled in the art is familiar with the fundamental construction of a turbo machine addressed here. For the sake of completeness it is mentioned here that a turbo machine comprises a rotor with moving blades on the rotor side and a stator with guide vanes on the stator side. The moving blades of the rotor form at least one moving blade row, wherein the or each moving blade row rotates together with a shaft of the rotor. The guide vanes of the stator form at least one guide vane ring which is tied to a housing on the stator side.

Figure 1:
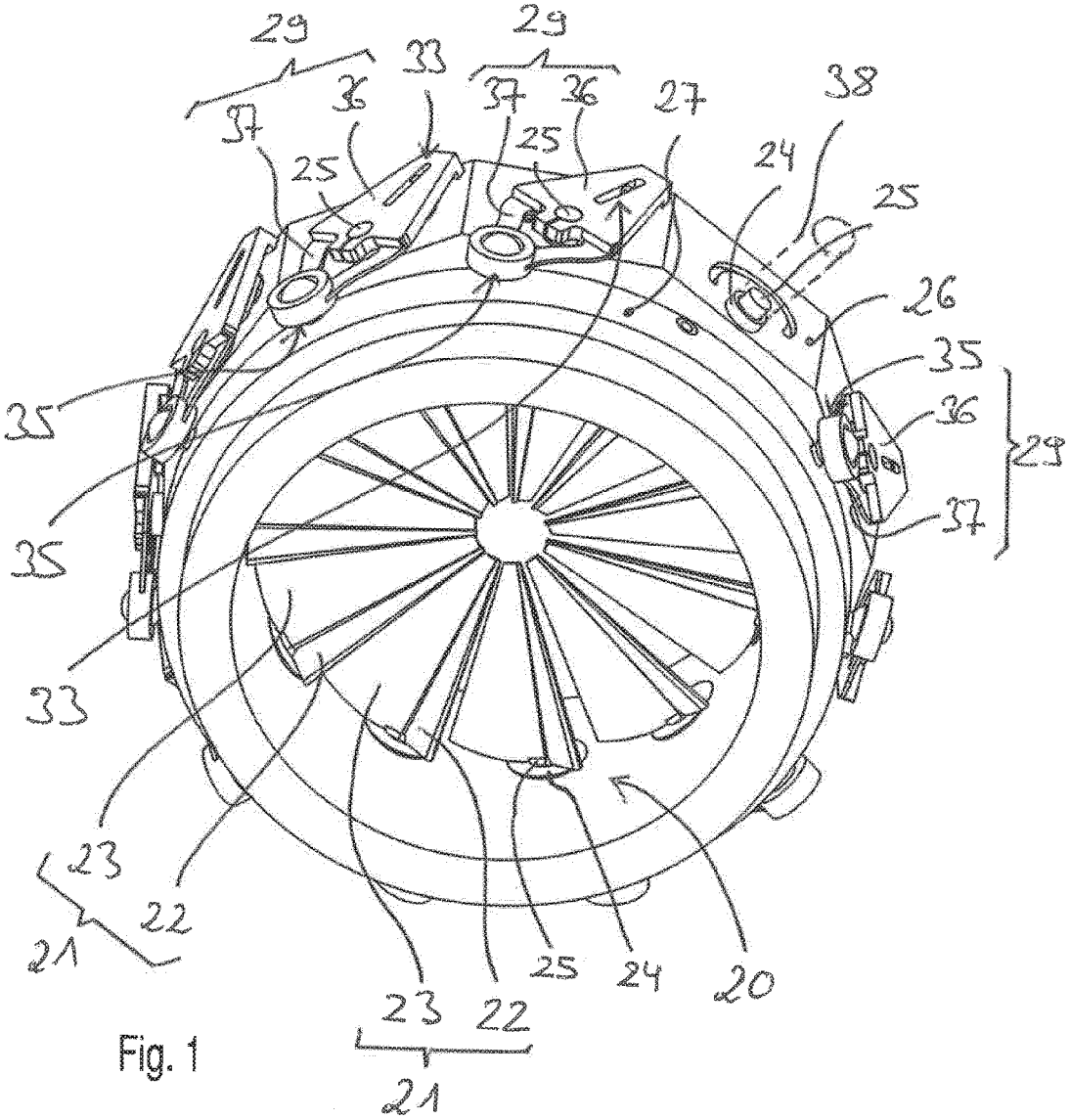
FIG. 1 is a perspective extract from a turbo machine in the region of a guide vane ring and a guide vane adjusting device for multi-part guide vanes of the guide vane ring.
Figure 2:
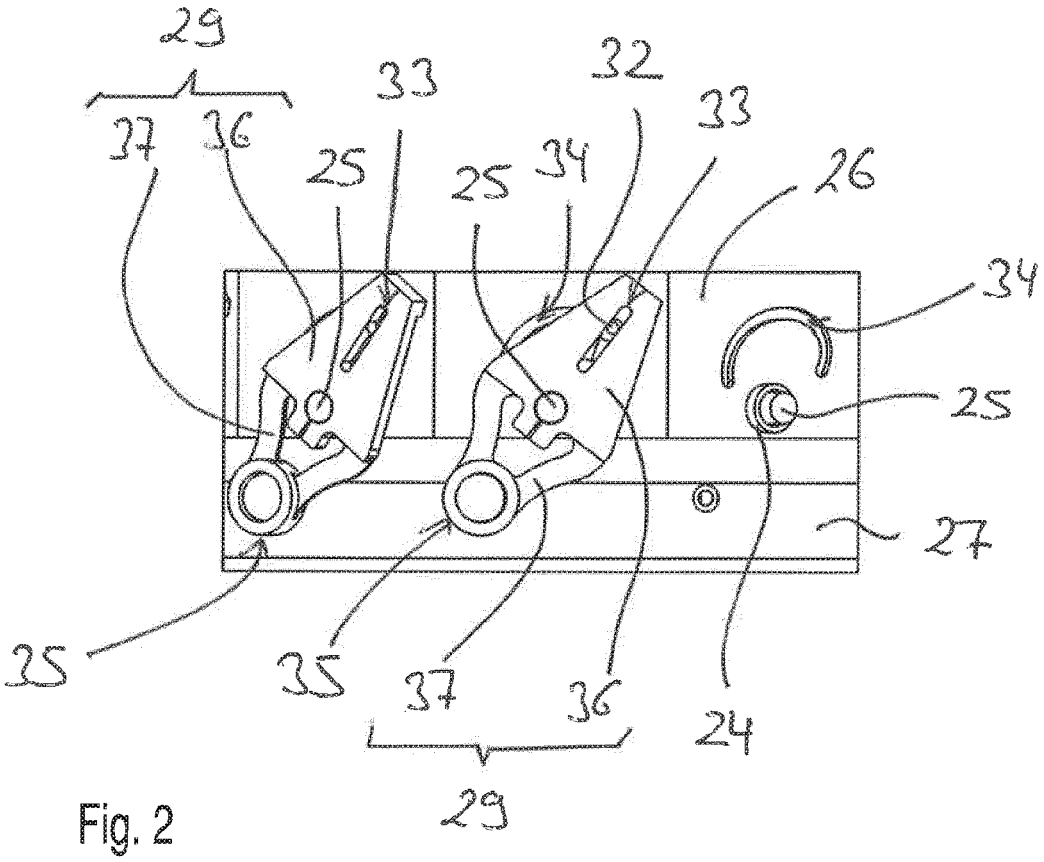
FIG. 2 is a plan view of the arrangement of FIG. 1 in a first state.
Figure 3:
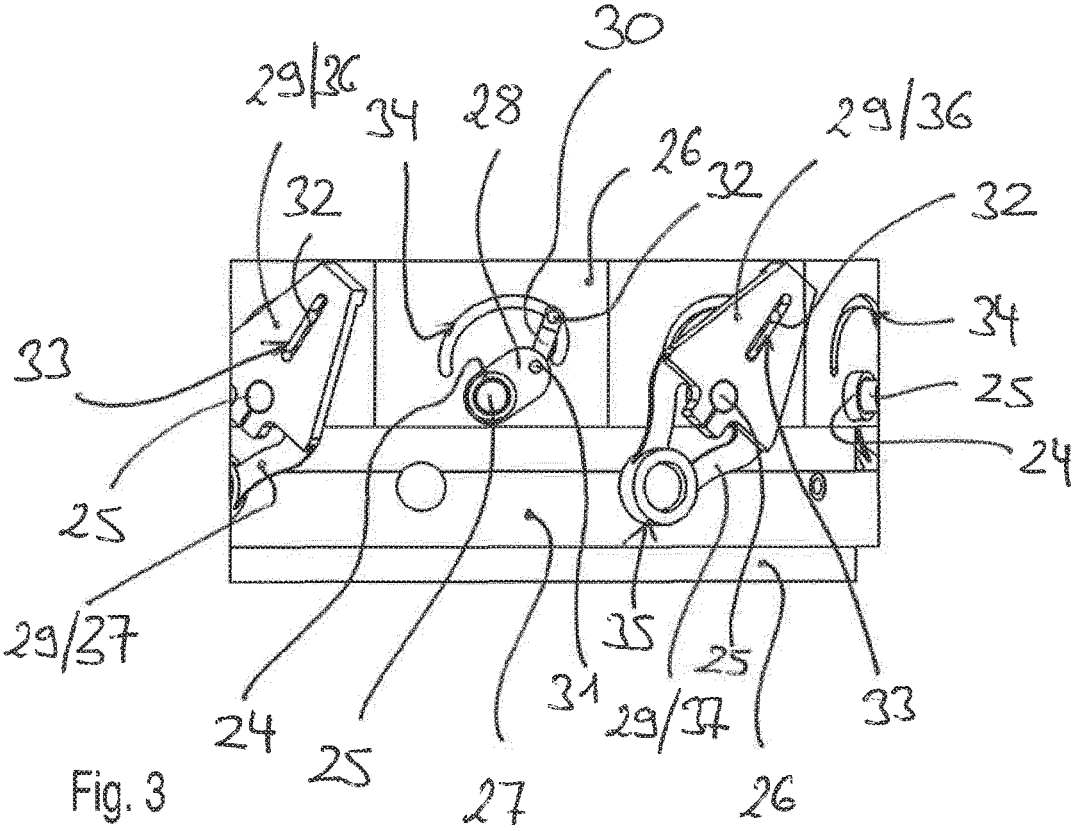
FIG. 3 is a plan view of the arrangement of FIG. 1 in a second state.
Figure 4:
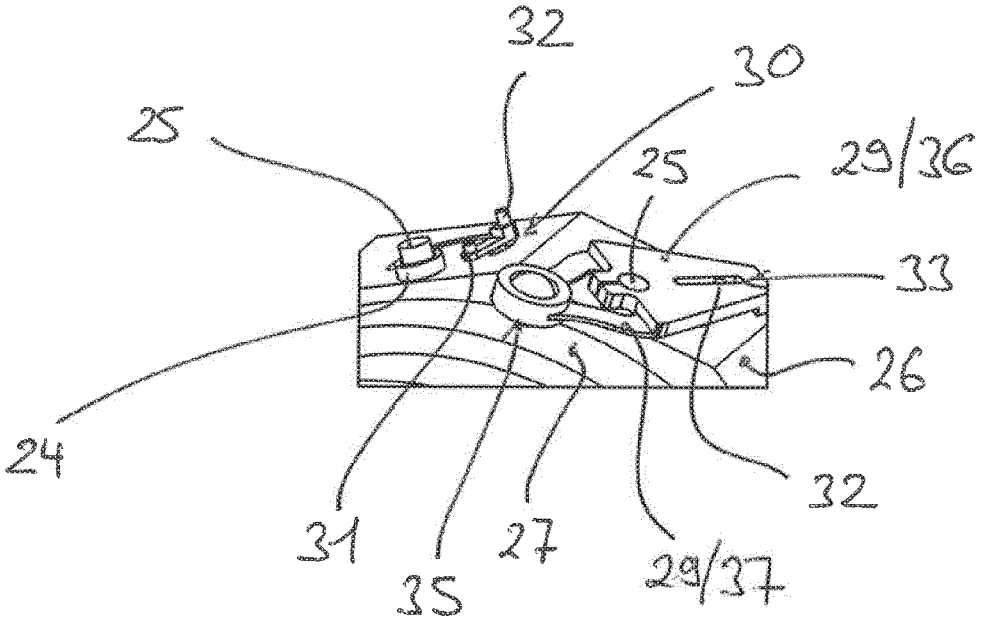
FIG. 4 is a perspective view of the arrangement of FIG. 3.

FIG. 1 as well as FIGS. 5 to 8 each show a perspective portion from a turbomachine, namely a perspective view of a so-called inlet guide apparatus of a turbomachine, with the help of which the flow of a process gas prior to entering an impeller can be specifically influenced. Accordingly, the inlet guide apparatus shown in FIGS. 1, 5 to 8 comprises a guide vane ring 20 having a plurality of guide vanes, wherein each guide vane 21 is formed in multiple parts, a front vane part 22 and a rear vane part 23. In the region of each guide vane 21, the two vane parts 22, 23 are rotatable relative to one another about a common axis of rotation, which extends in radial direction and is described as guide vane axis of rotation, so that accordingly the separating plane of the vane parts 22, 23 of each guide vane 21 extends through the common guide vane axis of rotation of the guide vanes.

In the region of each guide vane 21, the vane parts 22, 23 are mounted via bearing pins 24, 25 in a housing structure 26 of the turbomachine, wherein in the shown exemplary embodiment the bearing pins 24 of the front vane part 22 are embodied as hollow shafts and the bearing pins 25 of the rear vane parts 23 as solid shafts, namely in such a manner that the bearing pins 24 of the front vane parts 22 formed as hollow shafts concentrically enclose the bearing pins 25 of the rear vane parts 23 formed as solid shafts. It is pointed out here that obviously the bearing pins of the front vane parts can also be embodied as solid shafts and the bearing pins of the rear vane parts as hollow shafts, which again run concentrically relative to one another.

The guide vane adjusting device for the multi-part guide vanes 21 of the guide vane ring 20, with the help of which the vane parts 22, 23 of each guide vane 21 can be rotated about guide vane axes of rotation extending in radial direction, comprises a driveshaft 38 shown in FIG. 1 in dashed line, which can be coupled to a drive motor that is not shown and that can be driven by the drive motor. The driveshaft 38 is directly coupled to one of the guide vanes 21 of the guide vane ring 20, namely in such a manner that the vane parts 22, 23 of this guide vane 21 coupled to the driveshaft 38 is directly rotatable starting out from the driveshaft 38 without interposition of a control ring 27. In FIG. 1, the guide vane 21, the vane parts of which are directly rotatable starting out from the driveshaft without interposition of the control ring 27, is that guide vane, which in FIG. 1 is positioned approximately in the one o'clock position of the shown guide vane ring 20. The driveshaft 38 preferentially runs coaxially to the bearing pins 24, 25 of this guide vane 21 and thus preferentially coaxially to the guide vane axis of rotation of this directly rotatable guide vane 21. With the other guide vanes 21 of the guide vane ring 20, the driveshaft 38 is indirectly coupled via the control ring 27 namely in such a manner that the vane parts 22, 23 of these other guide vanes 21 of the guide vane ring 20 are indirectly rotatable starting out from the driveshaft 38 with interposition of the control ring 27.

Drive levers 28 and 29 acts on the bearing pin 24 of the front vane part 22 and on the bearing pin 25 of the rear vane part 23 of each guide vane 21. Accordingly, the driver lever 28 acts on the bearing pin 24 formed as hollow shaft of the front vane part 22 and the drive lever 29 on the bearing pin 25 embodied as solid shaft of the rear vane part 23. In the region of each guide vane 21, the drive levers 28, 29 of the vane parts 22, 23 are coupled among one another via a coupling device 30 in each case, namely in such a manner that the vane parts 22, 23 of each guide vane 21 are rotatably synchronously relative to one another.

In the region of each guide vane 21, the respective coupling device 30, which is embodied as coupling rod, is coupled to a drive lever about an axis running parallel to the respective guide vane axis of rotation. In the shown exemplary embodiment, the respective coupling device 30 is coupled to the drive lever 28, which is tied to the bearing pin 24 of the respective front vane part 22, about the axis 31 running parallel to the respective guide vane axis of rotation. The respective coupling device 30 is coupled, via a pin 32, which engages in a guide groove 33 of the respective other drive lever 29 and is guided in this guide groove 33, to the respective other drive lever, namely in the shown exemplary embodiment to the drive lever 29, which is tied to the bearing pin 25 of the rear vane part 23. Furthermore, the pin 32 engages in a guide groove 34 of the housing structure 26 of the guide vane ring with an opposite end.

The guide groove 33 of the respective guide lever 29 for the pin 32 is embodied as a linearly running elongated hole and the guide groove 34 of the housing structure 26 as an elongated hole extending in the shape of an arc.

The form of the guide groove 34 in the housing structure 26 determines the ratio of the angle of rotation between the respective front vane part 22 and the respective rear vane part 23, i.e. determines among other things if the vane parts 22, 23 of each guide vane are rotated proportionally or non-proportionally relative to one another.

In the region of each guide vane 21, one of the drive levers, in the shown exemplary embodiment the drive lever 29 for the respective rear vane part 23 of the respective guide vane 21, which acts on the bearing pin 25 of this vane part 23, is coupled in each case to the control ring 27. Here, a joint 35 is formed between the respective drive lever 29 and the control ring 27, via which the respective drive lever 29 acts on the control ring 27 in an articulated manner.

As already explained, a single one of the drive levers, namely the drive lever 29, which acts on the bearing pin 25 of the rear vane part 23 of the respective guide vane 21, is coupled in the region of each guide vane 21 to the control ring 27 in each case, wherein the control ring 27 is displaceable in circumferential direction and axial direction relative to the housing structure 26, however is fixed in radial direction. Forces at the coupling points between the control ring 27 and the drive levers 29 coupled to the control ring 27 in an articulated manner run perpendicularly to the drive levers 29, so that the levers are not loaded by parasitic force components. By way of this, a particularly advantageous rotating of the vane parts 22, 23 of each guide vane 21 relative to one another is possible.

In the shown figures, drive levers 28, 29 are shown, which serve for rotating the vane parts 22, 23 of those guide vanes 21 relative to one another, which are indirectly rotatable starting out from the driveshaft. Preferentially, the drive levers 28, 29 of those guide vanes 21, the vane parts of which are directly rotatable starting out from the driveshaft, are embodied analogously.

In the region of each guide vane 21, that drive lever, which is coupled to the control ring 27 via the respective joint 35 in an articulated manner, is designed as multi-part drive lever. In the shown exemplary embodiment, this is the drive lever 29 to which the bearing pin 25 of the rear vane part 23 of the respective guide vane 21 is coupled.

A first segment 36 of each of these drive levers 29 is rigidly coupled to the respective vane part 23 of the respective guide vane 21, namely coupled to the bearing pin 25 of this vane part 23. A second segment of these drive levers 29 acts on the control ring 27 via the respective joint 35 in an articulated manner. Furthermore, both segments 36, 37 of the respective drive levers 29 are coupled among one another in an articulated manner.

The other drive levers 28, which act on the respective other vane part 22 of the respective guide vane 21 or on the bearing pin 24 of the same are embodied as one-piece levers, wherein the respective coupling element acts on these in an articulated manner via the respective axis 31 running parallel to the respective vane axis of rotation.

Accordingly, the present invention proposes a guide vane adjusting device for a guide vane ring 20, the guide vanes 21 of which are embodied in multiple parts, namely in such a manner that each guide vane 21 comprises a front vane part 22 and a rear vane part 23 which can be rotated relative to one another about a common guide vane axis of rotation, wherein the separating plane of the respective vane parts 22, 23 extends through this guide vane axis of rotation. A drive lever 28 and 29 respectively is coupled in each case to each vane part 22, 23 of each guide vane 21, wherein the driver levers 28, 29 of each guide vane 21 are coupled among one another by way of a coupling element 30 designed as a coupling rod. The respective coupling rod 30 is connected to, in each case, one of the drive levers 28 in an articulated manner, namely about an axis 31 extending parallel to the guide vane axis of rotation. With a pin 32, the respective coupling rod 30 is guided both in a guide groove 33 of the other drive lever 29 as well as in a guide grove 34 of the housing structure 26. By way of this coupling of the drive levers 28, 29 of the vane parts 22, 23 of each guide vane 21, the vane parts 22, 23 of each guide vane 21 can be rotated synchronously to one another. One of the drive levers of each guide vane 21 is coupled to the control ring 27 which is displaceably arranged on the housing structure 26 in circumferential direction and axial direction. The respective drive lever 29, which is connected to the control ring 27, acts on the control ring 27 in an articulated manner. By way of the driveshaft 28, the rotation of the guide vane field 21 can be initiated, wherein a guide vane 21 is directly rotatable starting out from the driveshaft 38, whereas the other guide vanes 21 or their vane parts 22, 23 are indirectly rotatable starting out from the driveshaft via the control ring 27.

Figure 5:
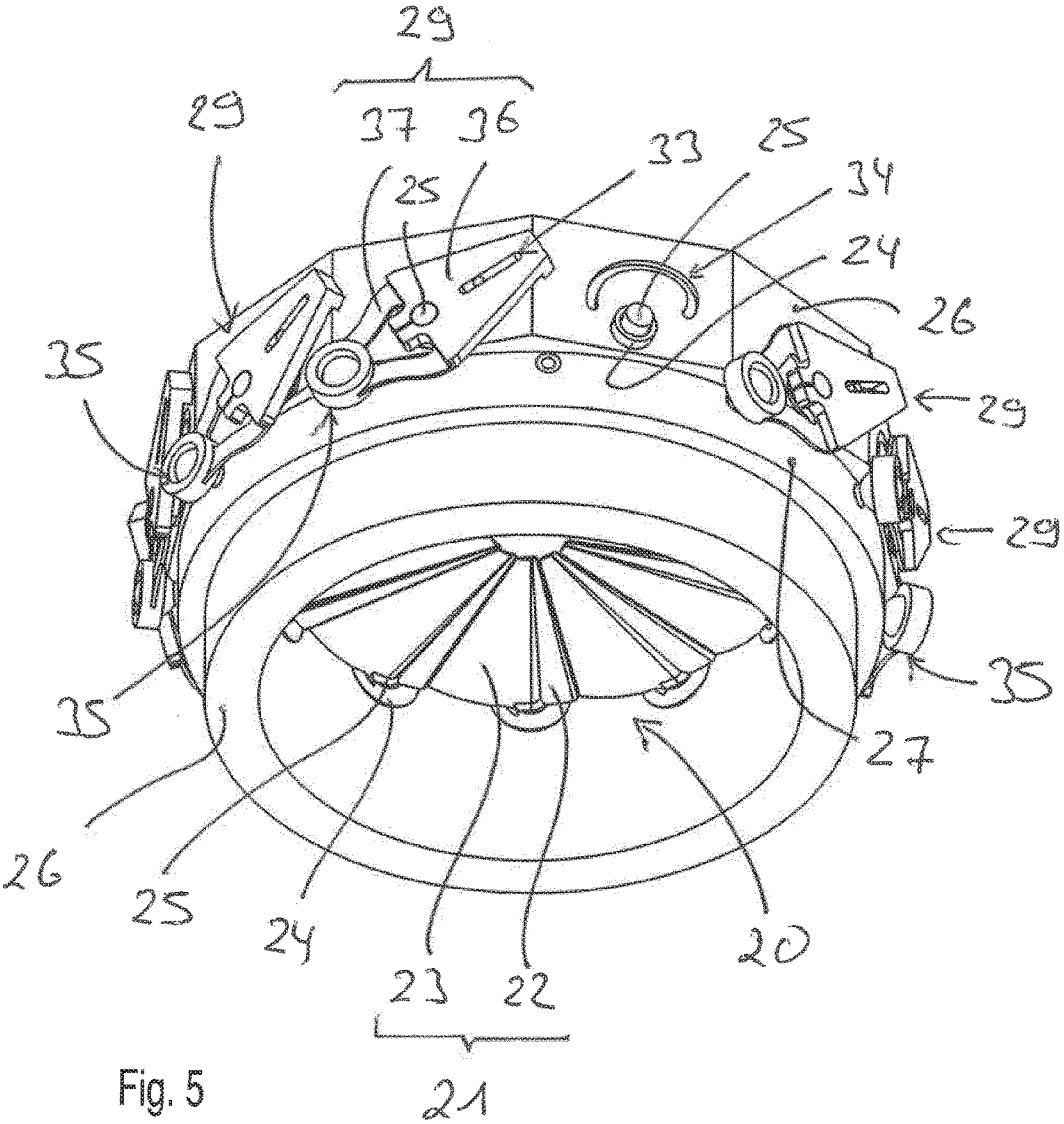
FIG. 5 is the arrangement of FIG. 1 with completely closed guide vanes in a 90° position for blocking a flow.
Figure 6:
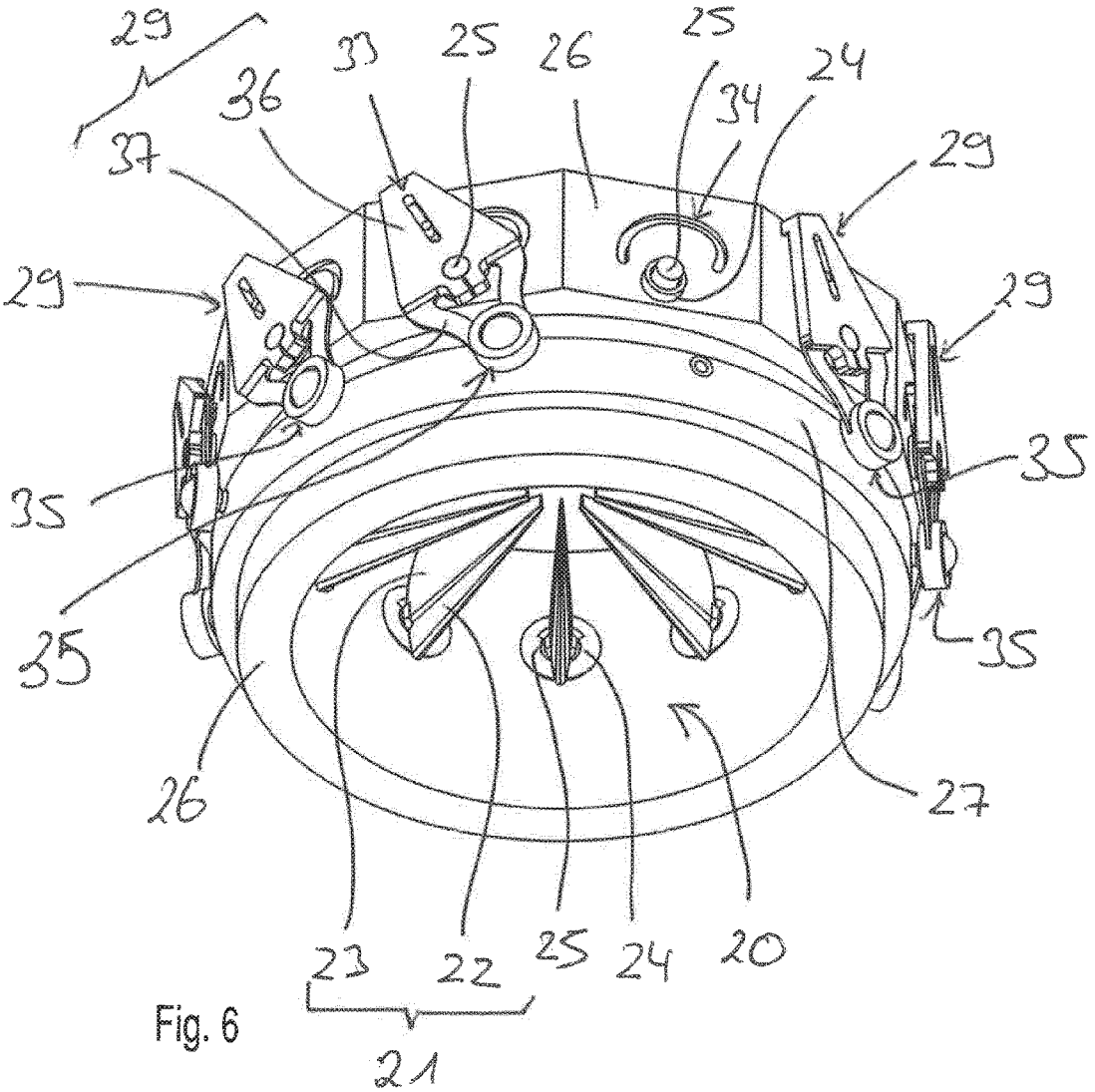
FIG. 6 is the arrangement of FIG. 1 with completely opened guide vanes in a 0° position for creating a swirl-free flow.
Figure 7:
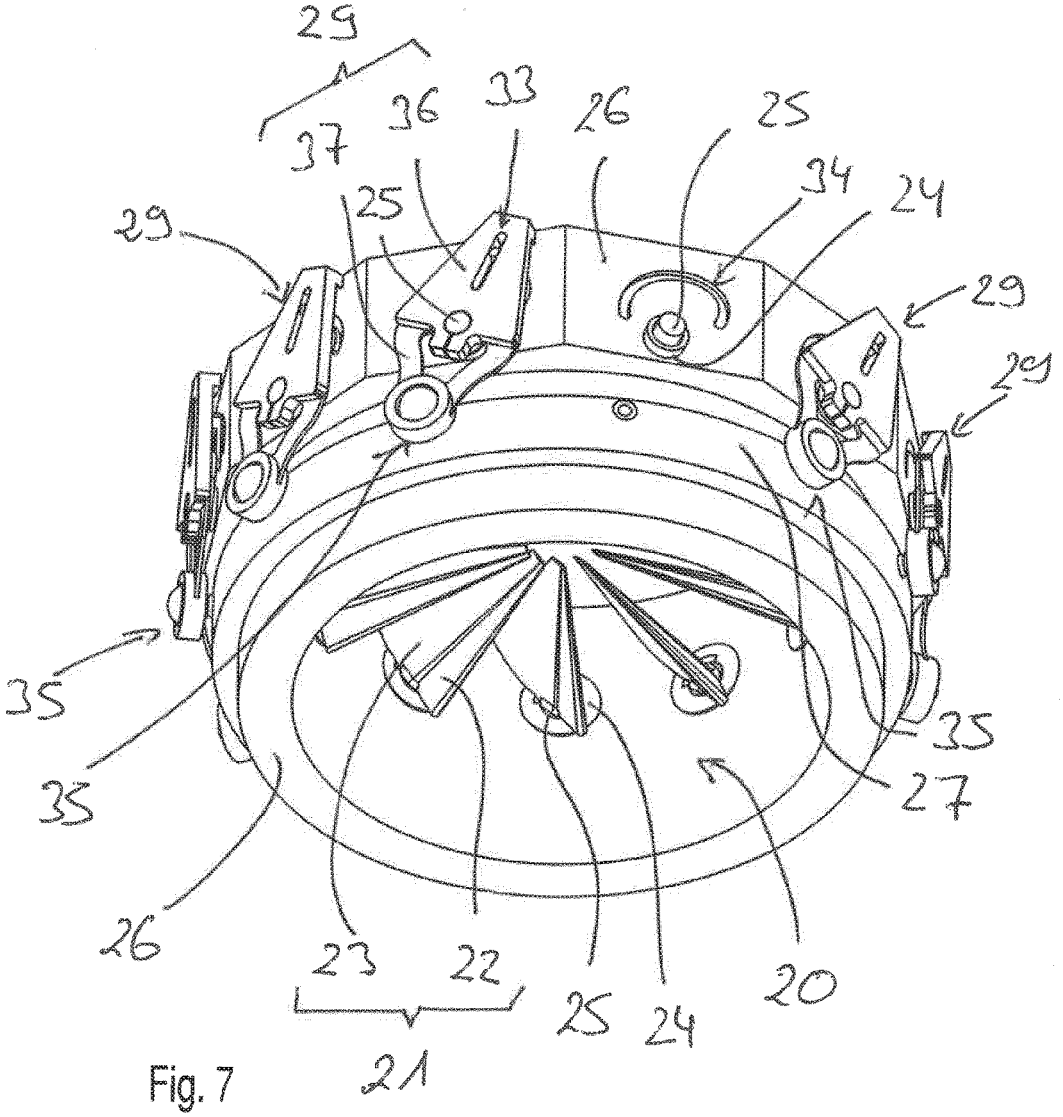
FIG. 7 is the arrangement of FIG. 1 with partly opened guide vanes in a 45° position for creating a flow with pre-swirl.
Figure 8:
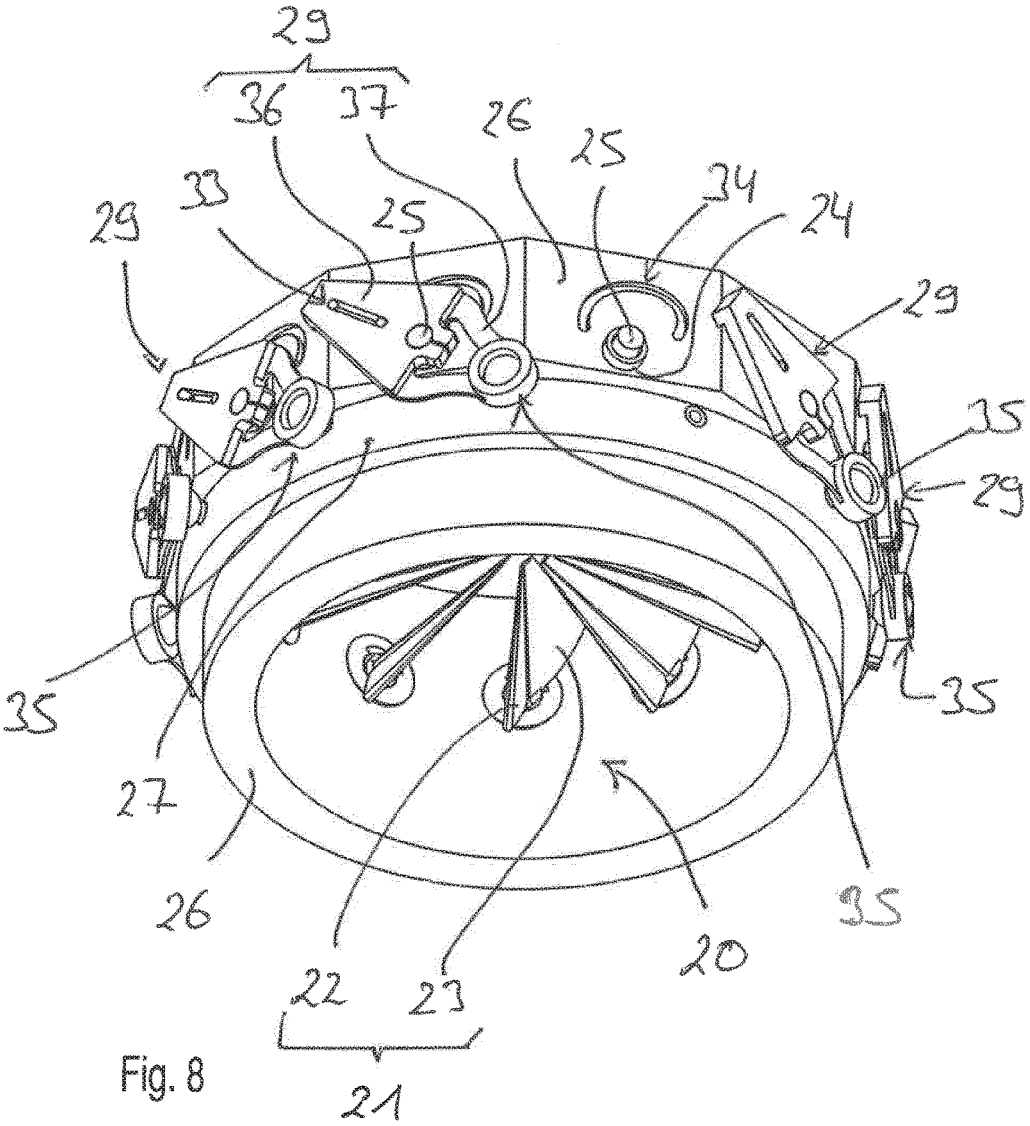
FIG. 8 is the arrangement of FIG. 1 with partly opened guide vanes in a 30° position for creating a flow with counter-swirl.
Figure 9:
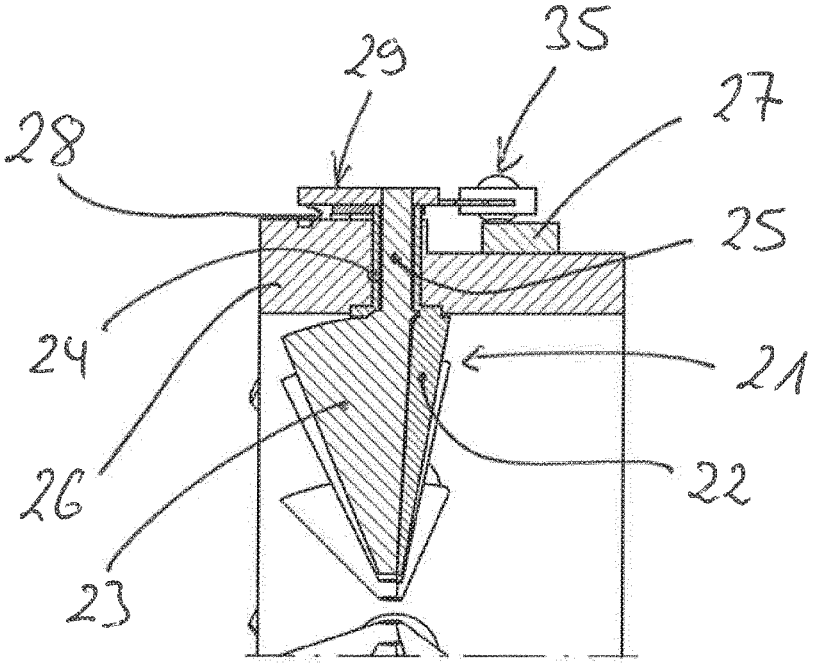
FIG. 9 is a partial cross section through the arrangement of FIG. 1 in the region of a guide vane.
Figure 10:
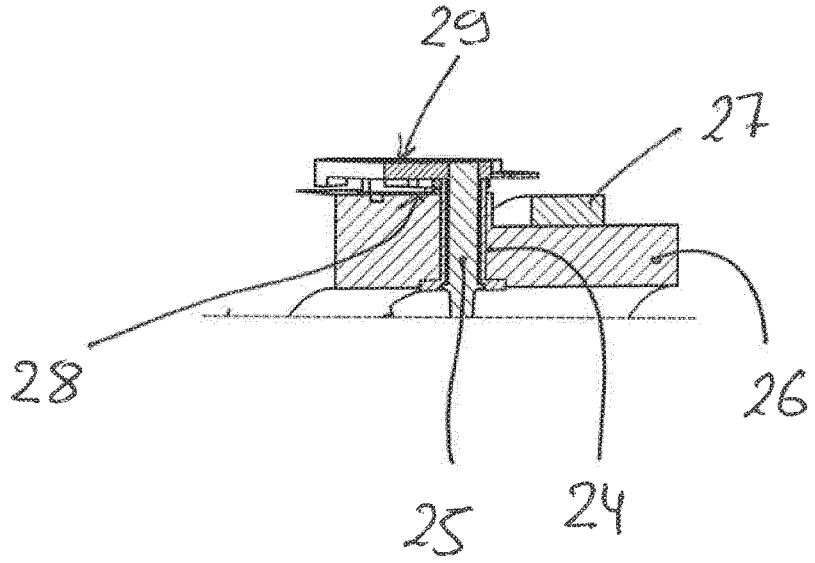
FIG. 10 is a further partial cross section through the arrangement of FIG. 1 in the region of a guide vane.

FIGS. 5 to 8 show the guide vane ring 20 in different relative positions of the guide vane 21 or of the vane parts 22, 23 of the same. In FIG. 5, the guide vanes 21 or the vane parts 22, 23 of the same take up a so-called 90° position, in which the flow through the guide vane ring 20 is maximally closed. In FIG. 6, by contrast, the guide vanes 21 or their vane parts 22, 23 are transferred into the so-called 0° position, in which the flow through the guide vane ring 20 is maximally opened. Here, no swirl is imposed on the flow in FIG. 6. FIGS. 7 and 8 show further relative positions of the guide vanes 21 or of the vane parts 22, 23, wherein in the so-called 45° position of the guide vane 21 according to FIG. 7, a so-called pre-swirl and in the so-called 30° position of the guide vane 21 according to FIG. 8, a so-called counter-swirl can be exerted on the flow flowing through the guide vane ring 20.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A guide vane adjusting device for a turbomachine, configured to rotate a plurality of guide vanes grouped into a guide vane ring about guide vane axes of rotation extending in radial direction of the guide vanes of the guide vane ring, each guide vane has a front vane part and a rear vane part, each of which can be rotated relative to one another about a common respective guide vane axis of rotation, comprising:

a driveshaft configured to be coupled to and driven by a drive motor;

a control ring that transmits a rotation of the driveshaft for rotating guide vanes of the guide vane ring to the plurality of guide vanes, wherein, the driveshaft is directly coupled to one of the guide vanes of the guide vane ring such that the vane parts of the one of the guide vanes of the guide vane ring is directly rotatable relative to one another about a common respective guide vane axis of rotation by the driveshaft without interposition of the control ring, wherein the driveshaft is indirectly coupled to the other guide vanes of the guide vane ring such that the vane parts of the other guide vanes of the guide vane ring are indirectly rotatable relative to one another about a common respective guide vane axis of rotation by the driveshaft with interposition of the control ring;

a respective drive lever that act on a respective bearing pin of each front vane part and a respective bearing pin of each rear vane part of the guide vane; and a respective coupling device that couples the respective drive lever of each respective guide vane, wherein respective guide vane are synchronously rotatable.

2. The guide vane adjusting device according to claim 1, wherein one of:

each bearing pin of the front vane part of each guide vane is a solid shaft and each bearing pin of the rear vane part of each guide vane is a hollow shaft, which run concentrically relative to one another, and each bearing pin of the front vane part of each guide vane is a hollow shaft and each bearing pin of the rear vane part of each guide vane is a solid shaft, which run concentrically relative to one another.

3. The guide vane adjusting device according to claim 1, wherein in a region of the guide vanes, one of the drive levers, which acts on the bearing pins of the vane parts of the respective guide vane, are coupled to the control ring.

4. The guide vane adjusting device according to claim 3, wherein the control ring is displaceable in circumferential direction and in axial direction so that forces at coupling points between the control ring and the drive levers coupled to the control ring in an articulated manner run perpendicularly to the drive levers.

5. The guide vane adjusting device according to claim 3, wherein in a region of the guide vane that is directly driveable by the driveshaft one of the vane parts is coupled to the control ring via one of the driver levers of the guide vane in an articulated manner, and wherein in that in the region of the guide vanes that are indirectly driveable starting out from the driveshaft one of the vane parts is likewise coupled to the control ring via one of the drive levers of the respective guide vane in an articulated manner.

6. The guide vane adjusting device according to claim 3, wherein the drive levers, via which a first of the vane parts of the guide vanes are coupled to the control ring, are multi-part levers, wherein a first segment of each multi-part lever is rigidly coupled to a respective vane part of the respective guide vane, whereas a second segment of the multi-part lever is coupled to the control ring in an articulated manner, and wherein the first segment is coupled to the second segment in an articulated manner.

7. The guide vane adjusting device according to claim 6, wherein the drive levers, which act on respective other vane part, are designed as one-piece levers.

8. The guide vane adjusting device according to claim 1, wherein the drive motor is a servo motor.

9. A guide vane adjusting device for a turbomachine, configured to rotate a plurality of guide vanes grouped into a guide vane ring about guide vane axes of rotation extending in radial direction of the guide vanes of the guide vane ring, each guide vane has a front vane part and a rear vane part, each of which can be rotated relative to one another about a common respective guide vane axis of rotation, comprising:

a driveshaft configured to be coupled to and driven by a drive motor;

a control ring that transmits a rotation of the driveshaft for rotating guide vanes of the guide vane ring to the plurality of guide vanes, wherein, the driveshaft is directly coupled to one of the guide vanes of the guide vane ring such that the vane parts of the one of the guide vanes of the guide vane ring is directly rotatable by the driveshaft without interposition of the control ring, wherein the driveshaft is indirectly coupled to the other guide vanes of the guide vane ring such that the vane parts of the other guide vanes of the guide vane ring are indirectly rotatable by the driveshaft with interposition of the control ring;

a respective drive lever that act on a respective bearing pin of each front vane part and a respective bearing pin of each rear vane part of the guide vane; and a respective coupling device that couples the respective drive lever of each respective guide vane, wherein respective guide vane are synchronously rotatable, wherein in a region of the guide vanes the respective coupling device is coupled to one of the drive levers about an axis running parallel to a respective guide vane axis of rotation, the respective coupling device is coupled to the other drive lever via a pin guided in a guide groove of a respective other drive lever and in a guide groove of a housing structure of the guide vane ring.

10. The guide vane adjusting device according to claim 9, wherein a form of the respective guide groove of the housing structure determines a ratio of angles of rotation between respective front vane parts and respective rear vane parts.

11. A turbomachine comprising:

a rotor comprising moving blades;

a stator comprising guide vanes, wherein the guide vanes form at least one guide vane ring and wherein the guide vanes of at least one guide vane ring are adjustable by a guide vane adjusting device, wherein the guide vane adjusting device comprises:

a driveshaft configured to be coupled to and driven by a drive motor;

a control ring that transmits a rotation of the driveshaft for rotating guide vanes of the guide vane ring to the plurality of guide vanes, wherein, the driveshaft is directly coupled to one of the guide vanes of the guide vane ring such that the vane parts of the one of the guide vanes of the guide vane ring is directly rotatable relative to one another about a common respective guide vane axis of rotation by the driveshaft without interposition of the control ring, wherein the driveshaft is indirectly coupled to the other guide vanes of the guide vane ring such that the vane parts of the other guide vanes of the guide vane ring are indirectly rotatable relative to one another about a common respective guide vane axis of rotation by the driveshaft with interposition of the control ring;

a respective drive lever that act on a respective bearing pin of each front vane part and a respective bearing pin of each rear vane part of the guide vane; and a respective coupling device that couples the respective drive lever of each respective guide vane, wherein respective guide vane are synchronously rotatable.

* * * * *